US006082431A

United States Patent [19]

Decola

[11] Patent Number: 6,082,431

[45] **Date of Patent: *Jul. 4, 2000**

[54] SYSTEM OF TELECOPING LONGITUDINALLY GROOVED DOOR-STIFFENING COLUMNS FOR BRACING GARAGE DOOR AGAINST HURRICANE FORCE WINDS

[76] Inventor: Salvatore Michael Decola, 1312 Pepper Tree Pl., Rockledge, Fla. 32955

[ * ] Notice: This patent is subject to a terminal disclaimer.

[21] Appl. No.: 09/390,031

[22] Filed: Sep. 2, 1999

Related U.S. Application Data

[63] Continuation of application No. 09/131,530, Aug. 10, 1998, Pat. No. 5,964,269.

[60] Provisional application No. 60/063,697, Oct. 28, 1997.

[51] Int. Cl.[7] ..... E05D 15/26

[52] U.S. Cl. ..... 160/209

[58] Field of Search ..... 160/209, 201, 160/207, 229.1, 405, 133, 264, 181, 182; 52/127.2, 167.3, 291

[56] References Cited

U.S. PATENT DOCUMENTS

| | | | |
|---|---|---|---|
| 3,424,223 | 1/1969 | Rosenblatt | 160/209 |
| 3,443,625 | 5/1969 | Moser et al. | 160/209 X |
| 5,383,509 | 1/1995 | Gaffney et al. | 160/209 |
| 5,445,207 | 8/1995 | Romanelli et al. | 160/209 |
| 5,620,038 | 4/1997 | DeCola et al. | 160/209 |
| 5,706,877 | 1/1998 | Grisham et al. | 160/201 |
| 5,732,758 | 3/1998 | Marko | 160/201 |
| 5,819,834 | 10/1998 | Wedekind | 160/209 |
| 5,964,269 | 10/1999 | Decola | 160/209 |
| 5,967,216 | 10/1999 | Mancini | 160/209 |

*Primary Examiner*—David M. Purol
*Attorney, Agent, or Firm*—Charles E. Wands

[57] ABSTRACT

A garage door bracing arrangement has a plurality of vertically extending door-stiffening column members, which are pivotally attached to upper mounting brackets affixed to garage building structure directly above the garage door opening. Lower mounting brackets are affixed to second ends of the column members and are anchored to the garage floor directly beneath the upper mounting brackets. The door-stiffening column members are configured as generally hollow, rigid, telescoping sections having longitudinal channels which retain fasteners that project from sides of the telescoping sections, so as to pass through holes in mounting brackets that affix the door-stiffening column members to the garage building structure, and deflection brackets that secure the column members to door panel hinge joints. The upper mounting bracket is configured to allow for a pivot swing type of movement, that eliminates pull stress from the upper bracket, when the bracing system is placed in an outward or suction condition created by high cross winds.

18 Claims, 4 Drawing Sheets

SYSTEM OF TELECOPING LONGITUDINALLY GROOVED DOOR-STIFFENING COLUMNS FOR BRACING GARAGE DOOR AGAINST HURRICANE FORCE WINDS

CROSS-REFERENCE TO RELATED APPLICATION

This is a continuation of U.S. application Ser. No. 09/131,530, filed Aug. 10, 1998, now U.S. Pat. No. 5,964,269, which issued Oct. 12, 1999 and provisional application 60/063,697 filed Oct. 28, 1997.

FIELD OF THE INVENTION

The present invention relates in general to garage door systems, and is particularly directed to a door bracing system made of grooved telescoping column members, that are attachable to a garage door and to the structure of the garage building proper, so as to reinforce and anchor a multi-paneled garage door against high velocity winds and burglar-forced entries. The bracing system precludes the door's panels from becoming detached during an intense storm, such as a hurricane, and thus averts greater damage to the interior of the garage and adjacent building structure, by preventing entry of violent wind into the garage and building that could otherwise cause the roof to blow off.

BACKGROUND OF THE INVENTION

FIG. 1 diagrammatically illustrates the configuration of a typical multi-panel residential garage door 10, as comprising a plurality of panels 11 (usually made of galvanized steel or fiberglass), which are hinged together at hinge joints 13. The hinge joints are equipped with side wheels or rollers 15 that ride in a pair of guide tracks 17, 18 that extend along opposite sides of the garage door opening 19. The guide tracks 17, 18 are usually anchored (e.g., bolted) to wall regions 21 and 22 of the garage adjacent to the opening 19 and attached via brackets 25 to the ceiling 26. The door 10 may be opened and closed either by hand or by way of an automated garage door translation device, such as may be mounted to the ceiling and attached to the topmost one of the door panels 11.

As described in DeCola et al, U.S. Pat. No. 5,620,038, entitled: "System for Bracing Garage Door Against Hurricane Force Winds," (assigned to the assignee of the present application, and the disclosure of which is incorporated herein), when a multi-panel garage door is exposed to high velocity winds of a violent storm, such as a hurricane, the door panels 11 have a tendency to separate from the guide tracks 17, 18 as a result of continued flexing of the panels and fatigue of the tracks themselves. This repeated flexing causes the side wheels 15 to become detached from the tracks 17, 18, so that the ends of panels 11 become warped, allowing wind to enter the garage and literally rip or 'peel' the door away from the garage door opening 19. Once the garage and adjacent structure has been blown out, the ceiling of the garage and adjacent structure are no longer protected from the extremely high velocity winds of the storm, and it is simply a matter of time before the roof blows off, causing the entire structure to be destroyed.

Follow-up investigation to the widespread damage to residential buildings in south Florida by hurricane Andrew in 1992 has revealed that had garage doors been reinforced against such separation from the guide tracks, and not blown out, the full force of the hurricane would not have been able to enter many of the destroyed houses. As a result of this investigation, homebuilders in coastal areas of south Florida are required to provide some form of hurricane reinforcement for their garage doors. Recommendations of how to accomplish this have usually involved the installation of (metal or wooden) girts that extend horizontally across each panel. Such girts are intended to stiffen the panels and prevent their oscillatory motion that leads to the destructive separation from the tracks.

Unfortunately, such stiffening panels add considerable weight to the door, requiring adjustments of both the lifting coil spring and of the drive of the automated garage door translation mechanism. Moreover, even with such adjustment, the substantial weight of the girts, for which neither the door nor the automated translation mechanisms were originally designed, leads to further wear and tear of the automatic garage door opener. Yet, even with such stiffeners, the fundamental problem they are intended to solve is not remedied, since they do not prevent torquing of the panels at the point of attachment of the door to the tracks, and do not effectively relieve the wind load placed on the entire garage door opening. The girts are unable to prevent torquing since they extend horizontally - making them parallel to joint lines between panels. Such an orientation provides axes of rotation, about which the panels are torqued when subjected to high velocity winds. The girts provide neither reinforcement nor a separation barrier along the lengths of the tracks, nor do they make the door a wind-loadable door.

Advantageously, the door-bracing system described in the above-reference ('038) patent remedies these shortcomings, by means of a door bracing system that contains a plurality of door-stiffening column members that are installed between associated upper mounting brackets above the garage opening and lower mounting brackets affixed to the garage floor. The door bracing system also includes deflection brackets which attach the door panel hinge joints to the column members, so that the entire vertical extent of the garage door is effectively braced against high velocity winds, and thereby prevented from separating along the guide tracks.

SUMMARY OF THE INVENTION

Now although the bracing system described in the '038 patent successfully provides secure door reinforcement against hurricane force winds, the present invention has been developed to provide an improved garage door bracing system that retains the structural rigidity of the multi-paneled door bracing system of the '038 patent, in what is considered to be an easier and less costly to manufacture, package and install door-bracing configuration.

For this purpose, the vertical door stiffening column members are configured as generally hollow, rigid, telescoping or interfitting sections, such as extruded aluminum alloy tubular sections, having longitudinal grooves or channels that extend along opposite sides thereof. Configuring the column members of rigid, hollow telescoping tubing sections significantly reduces the weight of the column members, without a reduction in strength, and facilitates packaging and assembly of the bracing system.

The longitudinal channels of the tubular sections are sized and shaped to receive the heads of threaded fasteners such as machine bolts or the like, so that the threaded ends of machine bolts project orthogonally to the sides of the telescoping tubes and readily pass through holes in mounting brackets that affix the column members to the garage, and deflection brackets, that secure the column members to the door panel hinge joints, so that the garage door panels are securely braced over the entire height of the garage door. As in the '038 patent, this provides an anchoring structure that prevents the garage door from being flexed off its tracks and becoming detached by intense winds, or as a result of the suction of the door outwardly by a vacuum created by intense cross winds.

The upper mounting bracket has a stamped shear form 'L' shape, with holes adjacent its corners for fasteners through which the bracket may be readily attached to the garage wall structure. The L-shaped bracket is sized to receive the closed end of a U-bolt fastened to the end of a door-stiffening column member, by a pair of U-bolt plates and secured to upper end of a column member by fasteners, such as hex-nuts or the like. This configuration allows for a pivot swing type of movement of the upper end of the column member, so as to eliminate pull stress from the upper bracket, when the bracing system is placed in a negative load (outward or suction) condition created by high cross winds.

A lower mounting bracket has a generally U-shaped, vertically extending channel portion, that receives the lower end of a column member. The lower mounting bracket may be anchored to the garage floor by machine bolts that are retainable by drop-ins, that fit in holes drilled into the floor. The machine bolts pass through holes in flanges of the lower mounting bracket. When not in use, the floor drop-ins are capped by the machine bolts.

To provide effective bracing of the entire garage door against panel separation from the guide tracks, the upper mounting brackets may be installed to the garage structure directly above the center of the door and to each side of the center. Associated lower mounting brackets are anchored to the garage door directly beneath these upper mounting brackets. In addition, one or more additional pairs of upper and lower mounting brackets may be installed adjacent to the garage door opening, so as to provide additional bracing across the width of the garage door. Attaching the garage door to these additional column members minimizes the potential for flexing of the garage door panels, and distributes the entire wind load to the header and the floor, thereby minimizing the stress on the door jam and tracks, so that the garage door opening will be securely braced against intense winds.

DETAILED DESCRIPTION

Figure 1:
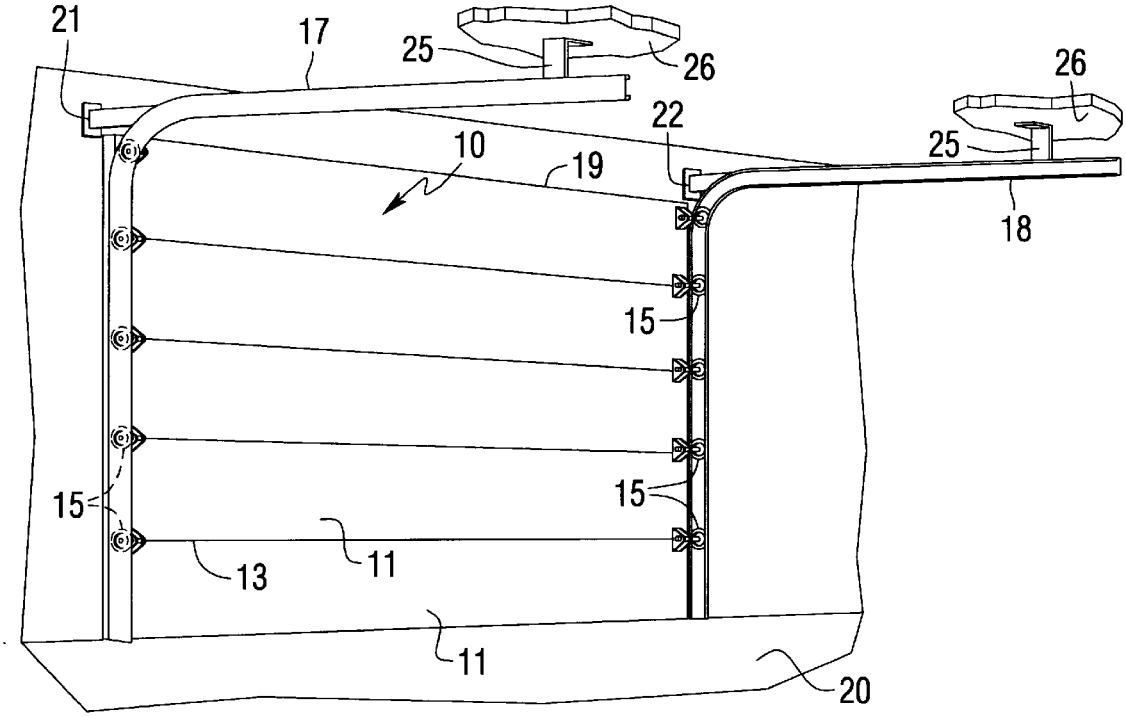
FIG. 1 PRIOR ART
FIG. 1 diagrammatically illustrates a conventional multi-panel configured garage door used for residential construction.
Figure 2:
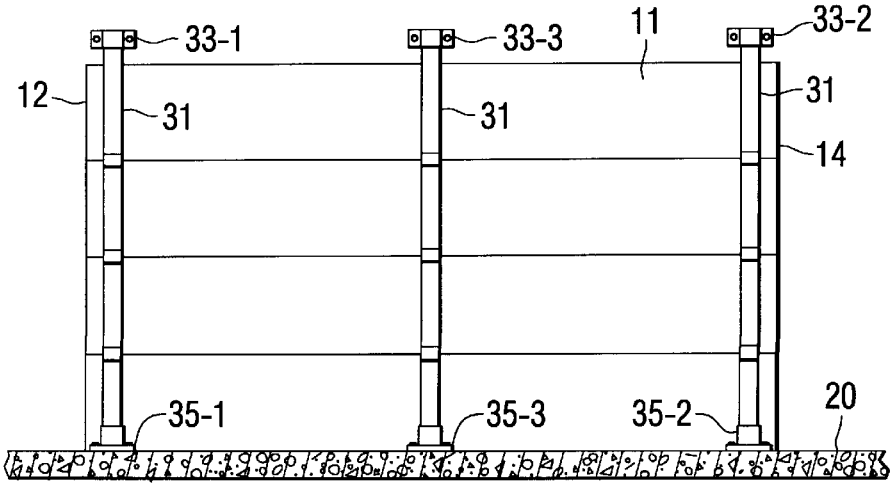
FIG. 2 diagrammatically illustrates a multi-panel configured garage door, braced by a plurality of door-stiffening column members in accordance with the invention.

Referring now to FIG. 2, the garage door bracing arrangement in accordance with the present invention is diagrammatically illustrated as comprising a plurality of vertically extending, door-stiffening hollow telescoping tubes 31, shown in detail in FIGS. 3–6, to be described. The door-stiffening column members 31 are retained immediately adjacent to the garage door by means of upper mounting brackets 33, that are affixed to the garage building structure directly above the garage door opening 19, and lower mounting brackets 35 that are anchored to the garage floor 20 directly beneath the upper mounting brackets 33.

As shown in detail in FIGS. 3–6, a respective column member 31 is comprised of a telescoping pair of interfitting upper and lower sections 81 and 82 of rigid tubing, such as extruded 6105-T6 aircraft alloy aluminum tubing, that readily accepts all attaching hardware with full adjustment, without having to be cut or drilled. To accommodate varying heights of garage door openings, each of the extruded rigid tubing sections 81 and 82 may have a length on the order of 57–60 inches, as a non-limiting example. For an overall column height of 104 inches, this provides for a 10–16 inch insertion overlap of the two interfitting sections. As pointed out above, this feature of the column member construction significantly reduces the cost of manufacture, packaging and assembly of the bracing system of the invention.

Figure 3:
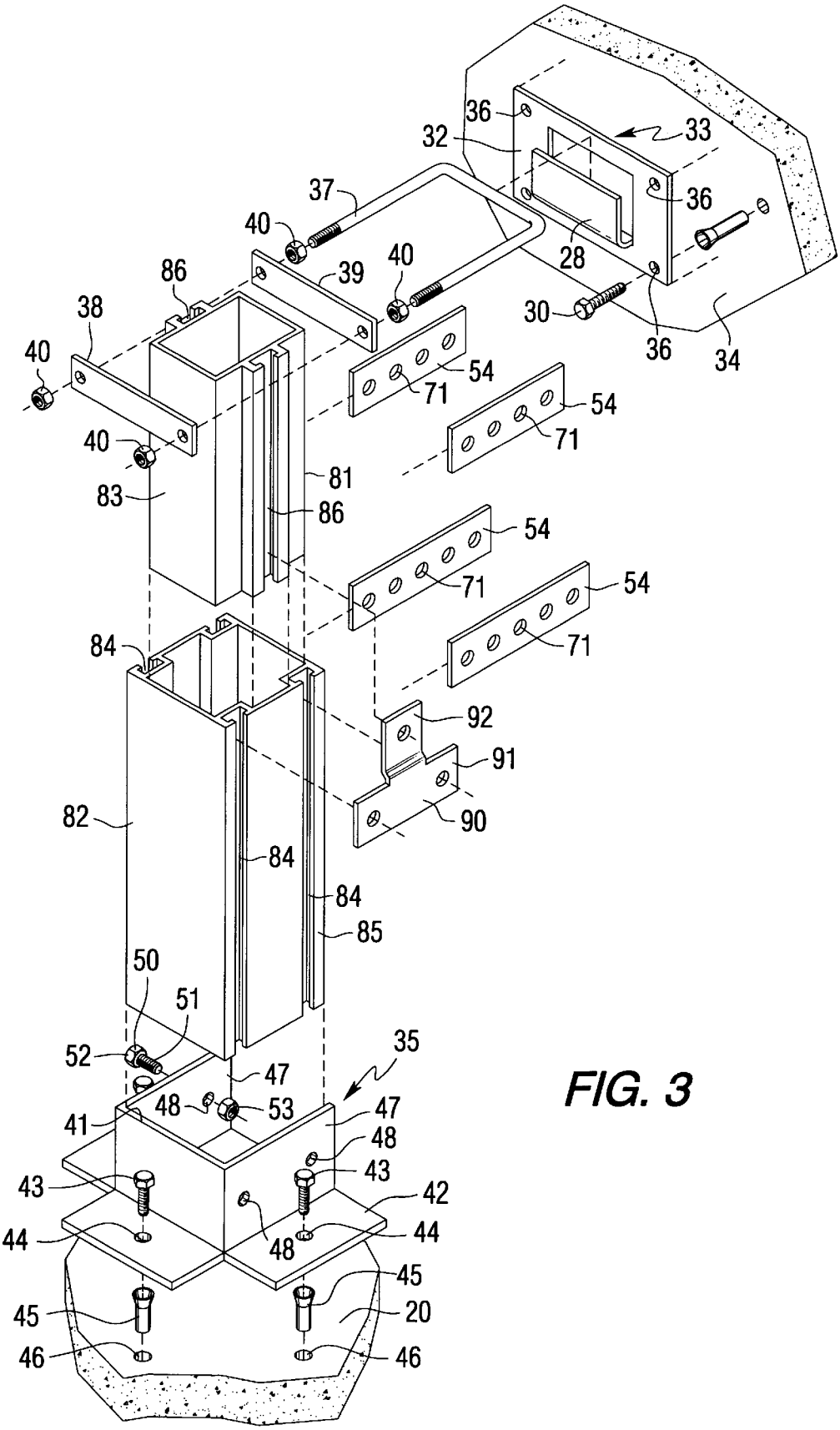
FIG. 3 is a diagrammatic perspective exploded view of a garage door bracing arrangement in accordance with the present invention.
Figure 4:
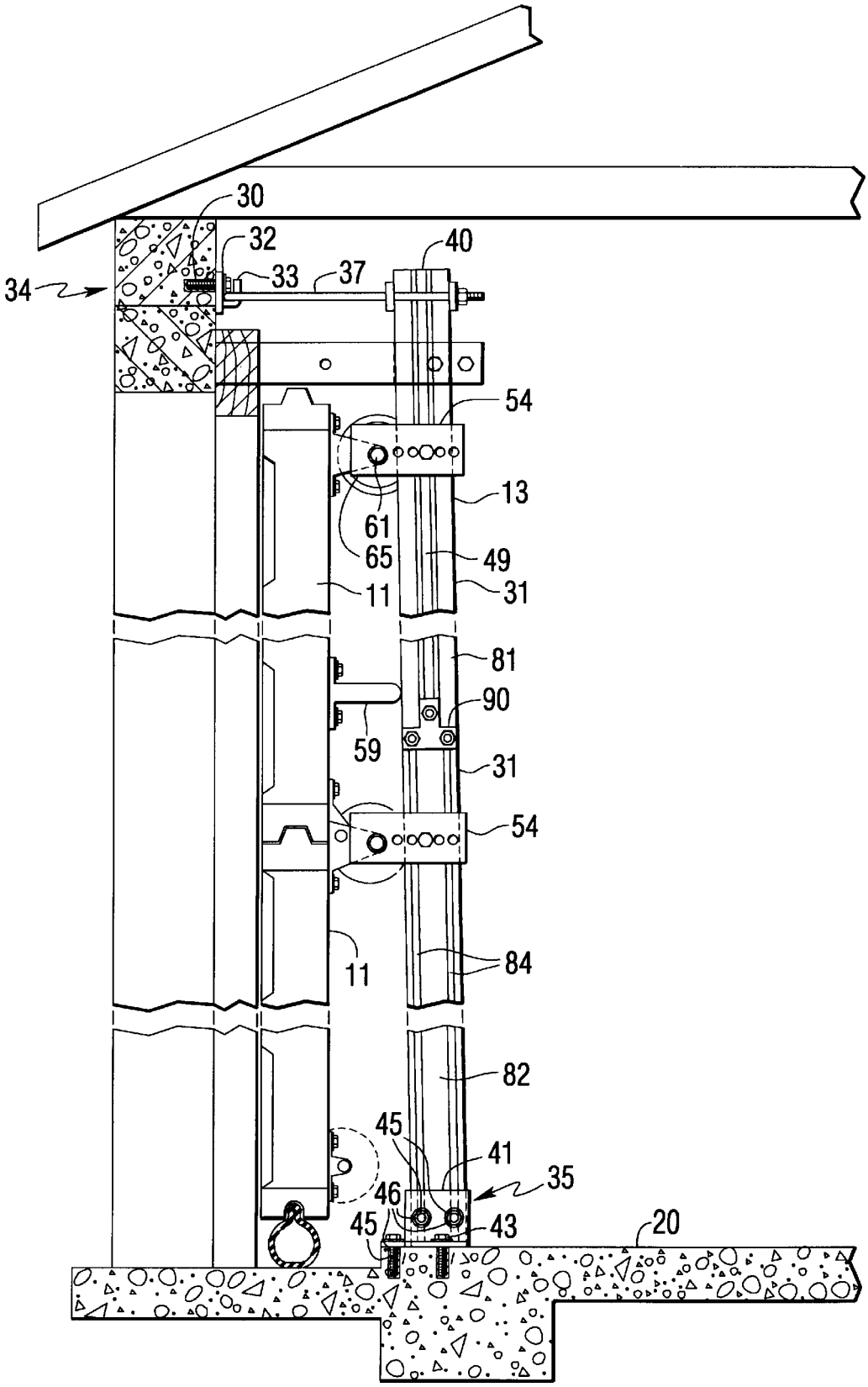
FIG. 4 is a diagrammatic side view of a garage door bracing column arrangement in accordance with the present invention.

As diagrammatically shown in the exploded perspective view of FIG. 3 and the side view of FIG. 4, a respective upper mounting bracket 33, which may be formed of 10-gauge galvanized steel as a non-limiting example, or equivalent strength and durability material, has a Isis generally shear form L-shape portion 28, that is punched out and protrudes from a surrounding flat surface portion 32 of the bracket. The bracket 33 may be fastened to the garage wall structure, by way of anchor elements 30, such as tapcon bolts, wood screws and the like, that pass through holes 36 in the flat surface portion 32 of the bracket and are secured into the garage wall (concrete or wood header) structure 34.

The generally L-shaped portion 28 of the upper bracket 33 is dimensioned to receive and retain the closed end of a threaded U-bolt 37, that is readily affixed to the top portion 83 of the upper rigid tubing section 81. As a non-limiting example, U-bolt 37 may affixed to the top portion 83 of the upper rigid tubing section 81 by means of a pair of retention plates 38 and 39 and hex nuts 40, that are threaded onto the U-bolt, so that the upper tubing section 81 is securely clamped between the two U-bolt retention plates. This upper bracket configuration allows for a 'pivot swing' type of movement, that eliminates pull stress from the upper bracket, when the bracing system is placed in a negative load (outward or suction) condition created by high cross winds.

As is further diagrammatically illustrated in FIGS. 3 and 4, the lower mounting bracket 35, which may also be formed of 10-gauge galvanized steel or equivalent strength and durability material, has a generally U-shaped, vertically extending channel portion 41, from which a plurality (e.g., three) base flanges 42 extend for mounting to the lower mounting bracket 35 to the garage floor 20. In the installed position, the flanges 42 may be anchored to the garage (concrete) floor by suitable fasteners 43, such as machine screws and the like, that pass through holes 44 in the flanges. The fasteners 43 may be readily inserted into external drop-ins 45 that are fitted into holes 46 drilled into the garage floor 20. When not in use, the drop-ins 44 may be covered with the machine screws 43.

The U-shaped channel portion 41 of the lower mounting bracket 35 is defined by a set of mutually adjoining side walls 47 opposite ones of which have mutually aligned holes 48. As diagrammatically shown in the cross-sectional end view FIG. 6, a respective hole 48 is sized to receive the threaded shaft 51 of a fastener such as a machine bolt 50 or the like. The head 52 of the machine bolt slidably fits into one of a pair of extruded grooves or channels 84 that extend along opposite sides 85 of the lower rigid tubing section 82, so that the machine bolt's threaded shaft 51 projects orthogonally to the side of the telescoping tube and thereby readily passes through a hole in the lower mounting bracket 35. A threaded fastener 53, such as a hex nut or the like may be threaded onto the threaded shaft 51 of the bolt 50, so as to affix the lower rigid tubing section 82 to the lower mounting bracket 35, and thereby securely anchor the lower rigid tubing section 82 to the garage floor immediately adjacent to the garage door 10.

The overall-height or length of the column member 31 is defined by a generally inverted T-shaped tubing section locking clip 90, which may be made of a high strength rigid material, such as 12-gauge galvanized steel, for example. Locking clip 90 has a T-bar 91 and an indented or offset leg 92. T-bar 91 has a pair of holes that are respectively aligned with the extruded grooves or channels 84 of the lower rigid tubing section 82. Similarly, leg 92 has a hole that is aligned with a generally longitudinal extruded channel 86 of the upper rigid tubing section 81.

As in the case of the lower mounting bracket, described above, the holes of the locking clip 90 are sized to receive threaded shafts of hexagonal head machine bolts or the like, the heads of which slidably fit into the extruded channels 84, 86 of the tubing sections, to provide for adjustment of the overall length of the column member. When the heads of the machine bolts are inserted into the channels, the machine bolts' threaded shafts project orthogonally from one side of the upper and lower tubing sections and thereby readily pass through the holes in the locking clip 90. Threaded fasteners, such as hex nuts or the like, may be threaded onto the threaded shafts of the machine bolts, so as to rigidly secure the locking clip 90 to the upper and lower tubing sections 81 and 82, and thereby join the upper and lower rigid tubing sections together.

As further shown in FIGS. 3 and 4, the door stiffening column members 31 are arranged to be attachable to deflection brackets 54 that are mounted to the door panel hinge joints 13. With the door stiffening column members 31 secured to the garage building structure via respective upper and lower mounting brackets 33 and 35, and with the garage door panels 11 attached to the thus secured column members 31 via the deflection brackets 54, the garage door panels 11 are securely braced by way of a garage door anchoring structure that prevents the garage door from being flexed off the tracks and becoming detached by the impact or vacuum created by intense winds.

Figure 5:
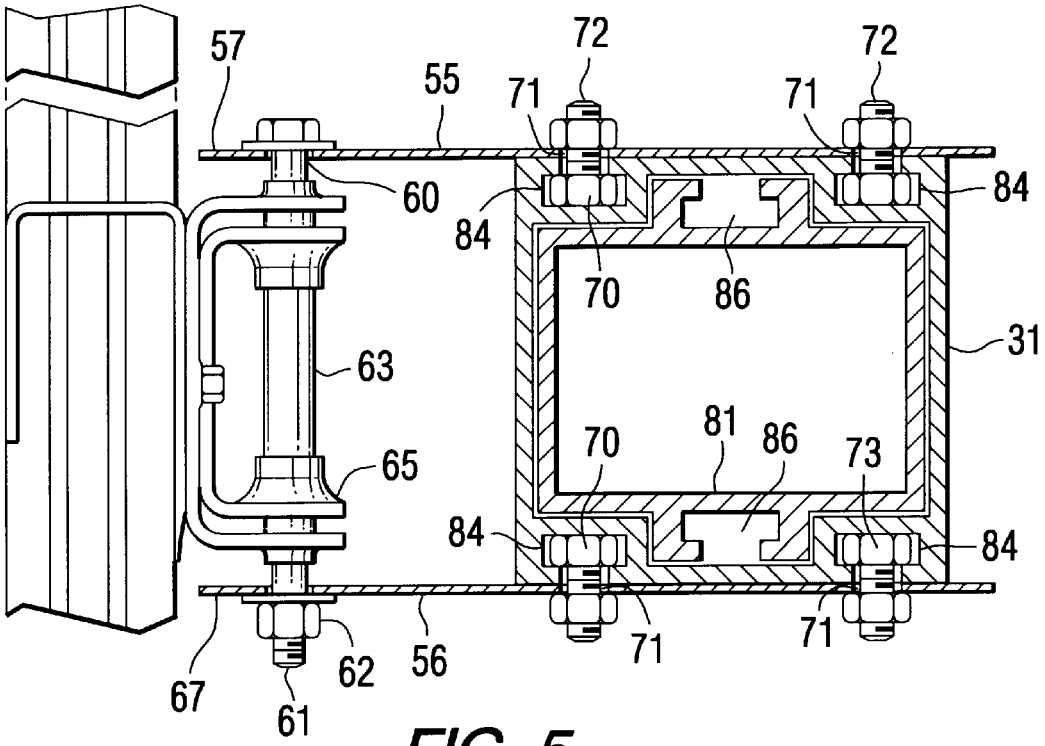
FIG. 5 is a top view of a deflection bracket.
Figure 6:
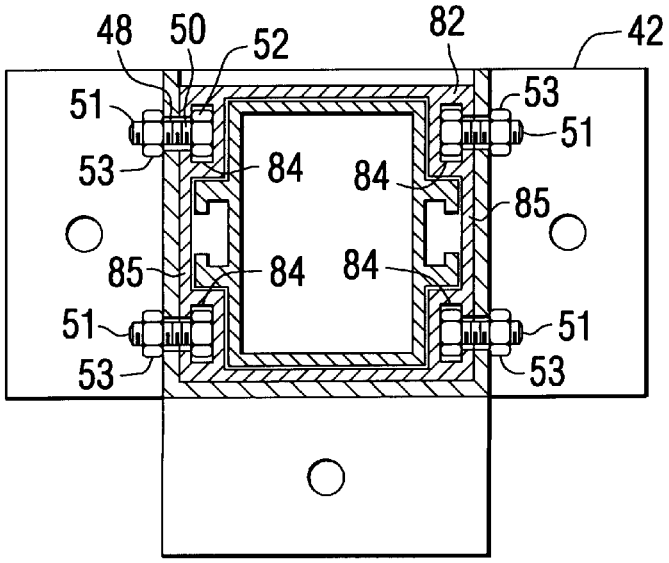
FIG. 6 is a diagrammatic cross-sectional end view of a lower rigid tubing section as retained by a lower mounting bracket.

A respective deflection bracket 54 is diagrammatically illustrated in the top view of FIG. 5 as comprising first and second generally flat deflection bracket members 55 and 56. As a non-limiting example, each deflection bracket member may be made of 12-gauge galvanized steel. A first end 57 of deflection bracket member 55 has a hole 60, which is sized to receive a bolt 61, or the like, that is sized to pass through a section of tubing 63 of a hinge joint fixture 65, which joins adjacent garage door panels 11 together. Similarly, a first end 67 of deflection bracket member 56 has a hole 68 which is sized to receive bolt 61, and allow a fastener, such as hex nut 62, or the like to be screwed onto a threaded end of bolt 61. The deflection bracket members 55 and 56 are dimensioned to fit snugly against edge portions of column member 31.

Like the lower mounting bracket 35 and the locking clip 90, the deflection bracket members 55 and 56 may be adjustably secured to the column members 31 by suitable fasteners 70 such as machine bolts or the like, which pass through holes 71 in the deflection bracket members 55 and 56, and which are retained in grooves or channels that extend longitudinally along the sides of the sections of telescoping tubing of the column members. This allows the threaded ends of the machine bolts to project orthogonally to the sides of the telescoping tubes and thereby readily pass through holes in the lower mounting brackets 35, and in the deflection brackets 55 and 56. As shown in FIG. 5, a respective hole 71 is sized to receive the threaded shaft 72 of a machine bolt 70, the head 73 of which slidably fits into a generally longitudinal extruded channel 84 that extends along the side 85 of the lower rigid tubing section 82, or into a generally longitudinal extruded channel 86 that extends along the side 87 of the upper rigid tubing section 81.

As diagrammatically illustrated in FIG. 2, first and second upper mounting brackets 33-1 and 33-2 may affixed to the garage building structure adjacent to or inwardly from the side edges 12, 14 of the garage door panels 11, with associated first and second lower mounting brackets 35-1 and 35-2 anchored to the garage floor 20 directly beneath the upper mounting brackets 33-1 and 33-2, respectively. Locating these pairs of upper and lower mounting brackets adjacent to the door panels places the vertical bracing at the locations of garage door where it is needed most—on the first set of hinges inwardly from the edge of the garage door panels with the guide tracks. Preferably, as shown in FIG. 4, the anchor points for the upper and lower mounting brackets are such as to place the column members 31 slightly spaced apart from or directly against horizontally extending U-bar members 59 of the garage door 10.

In addition to installing respective door-stiffening column members by way of pairs of upper and lower mounting brackets to the garage building structure adjacent to the side edges 12, 14 of the garage door panels 11, one of more additional pairs of door-bracing column members may be affixed to the garage building structure between the side edges of the garage door opening 19, as shown at 33-3 in FIG. 2, as a non-limiting example, so as to provide additional bracing across the width of the garage door 10. With the garage door 10 attached to these additional column members, the potential for flexing of the garage door panels is significantly minimized, so that the garage door, track and jam will be securely braced against the wind, thus protecting the interior of the garage and the adjoining building structure. Tests have shown that installing a three brace system in the manner illustrated in FIG. 2, using the door-stiffening column members of the present invention, allows a standard garage door designed to withstand winds up to 70 mph is able to sustain winds of up to 180 mph.

As will be appreciated from the foregoing description, the improved telescoping grooved column members-based garage door bracing arrangement of the present invention not only overcomes the inability of conventional hinge-panel garage doors to withstand extremely strong winds of intense storms such as hurricanes and tornadoes, but does so in a manner that retains the structural rigidity of the multi-paneled door bracing system of the '038 patent, in an easier and less costly to manufacture, package and install door-bracing configuration.

While I have shown and described an embodiment in accordance with the present invention, it is to be understood that the same is not limited thereto, but is susceptible to numerous changes and modifications as known to a person skilled in the art, and I therefore do not wish to be limited to the detail shown and described herein, but intend to cover such changes and modifications as are obvious to one of ordinary skill in the art.

What is claimed:

1. A door bracing arrangement for bracing a multi-panel garage door having hinge joints between panels thereof, against separation from guide tracks installed along side portions of a garage structure adjacent to an opening thereof, comprising:

a plurality of telescoping door-stiffening column members, having longitudinal channels configured to retain fasteners for mounting brackets that are adapted to affix said telescoping door-stiffening column members to said garage structure, and deflection brackets that are adapted to affix said door-stiffening column members to door panel hinge joints, a respective door-stiffening column member being comprised of generally rigid, telescoping longitudinally shaped sections that longitudinally slidably interfit with one another to provide longitudinal adjustment of the lengths of said respective door-stiffening column members along a longitudinal direction thereof, while preventing relative pivoting therebetween;

an upper mounting bracket adapted to be affixed to said garage structure above said opening for said multi-panel garage door, and being attachable to a first end of a door-stiffening column member; and deflection brackets adapted to attach door panel hinge joints to said door-stiffening column members, and having sidewall deflection members that are adapted to extend generally away from said multi-panel garage door and extend alongside said door-stiffening column members, said sidewall deflection members being attachable to said door-stiffening column members at selected locations between said door-stiffening column members and door panel hinge joints.

2. A door bracing arrangement according to claim 1, further including a lower mounting bracket adapted to be affixed to a second end of a door-stiffening column member and having a floor anchoring portion by way of which said door-stiffening column members are anchored to a garage floor.

3. A door bracing arrangement according to claim 1, wherein said pair of sidewall deflection members includes holes alignable with a passageway through a door panel hinge joint, receiving a fastener which is adapted to securely attach deflection members to said door panel hinge joint.

4. A door bracing arrangement according to claim 1, wherein said upper mounting bracket is pivotally attachable to allow for said door-stiffening column members, so as to eliminate pull stress from said upper bracket, when the bracing system is placed in a negative load condition.

5. A door bracing arrangement according to claim 1, wherein an upper mounting bracket has a generally L-shaped element that is mountable above an opening for said garage door, and further including a U-shaped fastener affixed to a door-stiffening column member, said U-shaped fastener having a closed end that is received and retained by said generally L-shaped element of said upper mounting bracket.

6. A door bracing arrangement according to claim 5, wherein said U-shaped fastener comprises a threaded U-bolt that is adjustably clampable to an upper rigid tubing section of a door-stiffening column member.

7. A door bracing arrangement according to claim 6, further including a lower mounting bracket having a generally U-shaped, vertically extending channel portion sized to receive a lower end of a door-stiffening column member, and a base flange for anchoring a lower end of a door-stiffening column member to said garage floor.

8. A door bracing arrangement according to claim 7, wherein said generally telescoping door-stiffening column members are joined together by means a locking clip attached by fasteners to said telescoping door-stiffening column members.

9. A door bracing arrangement according to claim 8, wherein said locking clip is a generally T-shaped member having holes sized to receive shafts of bolt members, heads of which slidably fit into longitudinal channels of said telescoping sections, to provide for adjustment of the overall length of a column member, and secured by fasteners threaded onto said shafts of said bolt members, so as to rigidly secure said locking clip to said telescoping sections, and thereby joining said telescoping sections together.

10. A method for bracing a multi-panel garage door having hinge joints between panels thereof, against separation from guide tracks installed along side portions of a garage structure adjacent to an opening thereof, comprising the steps of:

(a) installing telescoping door-stiffening column members adjacent to an opening of a garage structure for said multi-panel garage door, by affixing first ends of said door-stiffening column members to upper mounting brackets, and attaching said upper mounting brackets above said opening, a door-stiffening column member comprised of generally rigid, telescoping longitudinally shaped sections that longitudinally slidably interfit with one another to provide longitudinal adjustment of the length of said door-stiffening column member along a longitudinal direction thereof, while preventing relative pivoting therebetween and having longitudinal channels configured to retain fasteners attachable to mounting brackets that are adapted to affix said telescoping door-stiffening column members to said garage structure, and deflection brackets that are adapted to affix said door-stiffening column members to door panel hinge joints, each door-stiffening column member having a first end thereof attachable to an upper mounting bracket mountable to said garage structure above said opening; and (b) attaching panels of said multi-panel garage door to said door-stiffening column members by deflection brackets, a deflection bracket having sidewall deflection members that extend generally away from said multi-panel door and alongside door-stiffening column members, said sidewall deflection members receiving fasteners for securely attaching said door-stiffening column member to said deflection brackets at a selected locations between said door-stiffening column members and door panel hinge joints.

11. A method according to claim 10, further including the step of:

(c) anchoring second ends of said door-stiffening column members to a garage floor portion of said garage structure by means of respective lower mounting brackets, a lower mounting bracket being adapted to be affixed to a second end of said door-stiffening column member and having a floor anchoring portion by way of which said door-stiffening column member may be anchored to a garage floor beneath an attachment location of said upper mounting bracket to said garage structure.

12. A method according to claim 10, wherein said sidewall deflection members include holes alignable with a passageway through a door panel hinge joint, and adapted to receive a fastener therethrough for securely attaching said pair of deflection members to said door panel hinge joint.

13. A method according to claim 10, wherein said upper mounting bracket is configured to allow for pivot movement of a door-stiffening column member, so as to eliminate pull stress from said upper bracket in the case of a negative load condition.

14. A method according to claim 10, wherein step (a) includes providing U-shared fasteners, and said upper mounting bracket has a generally L-shaped element that is mountable above an opening for said garage door, and is adapted to receive and retain a closed end of a U-shaped fastener that is affixable to a door-stiffening column member.

15. A method according to claim 14, wherein said U-shaped fastener comprises a threaded U-bolt that is adjustably clampable to said door-stiffening column member.

16. A method according to claim 15, wherein a lower mounting bracket has a generally U-shaped, vertically extending channel portion that is sized to receive a lower end of said door-stiffening column member, and a base flange for anchoring said lower end of said door-stiffening column member to said garage floor.

17. A method according to claim 10, wherein step (a) comprises joining said telescoping sections together by attaching a locking clip to said longitudinal channels of said telescoping sections.

18. A method according to claim 17, wherein said locking clip is a generally T-shaped member having holes sized to receive shafts of bolt members, heads of which slidably fit into said longitudinal channels of said telescoping sections, to provide for adjustment of the overall length of said column member, and secured by fasteners threaded onto said shafts of said bolt members, so as to rigidly secure said locking clip to said telescoping sections, and thereby join said telescoping sections together.

* * * * *